US007866065B2

(12) United States Patent
Munns

(10) Patent No.: US 7,866,065 B2
(45) Date of Patent: Jan. 11, 2011

(54) INTEGRATED BUCKLE STRAP RECEIVER FOR FOOTWEAR

(75) Inventor: Jon Munns, Gilroy, CA (US)

(73) Assignee: Fox Head, Inc., Morgan Hill, CA (US)

( * ) Notice: Subject to any disclaimer, the term of this patent is extended or adjusted under 35 U.S.C. 154(b) by 1212 days.

(21) Appl. No.: 11/458,055

(22) Filed: Jul. 17, 2006

(65) Prior Publication Data

US 2007/0101615 A1 May 10, 2007

Related U.S. Application Data

(60) Provisional application No. 60/735,302, filed on Nov. 10, 2005.

(51) Int. Cl.
*A43B 13/22* (2006.01)
*A43B 5/00* (2006.01)
*A43C 11/00* (2006.01)

(52) U.S. Cl. ..... 36/131; 36/113; 36/50.1; 24/68 SK

(58) Field of Classification Search ..... 36/50.5, 36/50.1, 117.1, 113, 131, 45; 24/68 SK, 24/69 SK, 70 SK, 71 SK
See application file for complete search history.

(56) References Cited

U.S. PATENT DOCUMENTS

| | | | |
|---|---|---|---|
| 808,666 | A | 1/1906 | Linthicum |
| 1,332,472 | A | 3/1920 | Shibley |
| 1,478,467 | A | 12/1923 | Binns |
| 1,478,468 | A | 12/1923 | Binns et al. |
| 1,621,342 | A | 3/1927 | Webber |
| 1,660,046 | A | 2/1928 | Phillips |
| 1,794,035 | A | 2/1931 | Linus Schonfeld |
| 1,851,629 | A | 3/1932 | Herzstein |
| 2,053,813 | A | 9/1936 | Brennan |
| 2,097,200 | A | 10/1937 | Menutole |
| 2,427,459 | A | 9/1947 | Jastrzomb |
| 2,642,678 | A | 6/1953 | Fula |
| 2,779,109 | A | 1/1957 | Pizzo et al. |
| 3,091,871 | A | 6/1963 | Tronche |

(Continued)

FOREIGN PATENT DOCUMENTS

| | | |
|---|---|---|
| EP | 0986969 | 3/2000 |

(Continued)

OTHER PUBLICATIONS

30 Years of Maximum Motocross—1974-2004—FOX—Product Catalog; Copyright 2003; Fox Racing, Inc. Morgan Hill, California; pp. 14-18, and 77 (7 pages total).

(Continued)

*Primary Examiner*—Jila M Mohandesi
(74) *Attorney, Agent, or Firm*—Ganz Law, P.C.

(57) ABSTRACT

An attachment system for securing footwear to a wearer's foot that includes an integrated buckle strap receiver, which may be disposed on a portion of a footwear upper, comprising an overstrap and securing plate having a unitary construction; a buckle strap having a first end and a second end, wherein the first end of the buckle strap is capable of engaging the integrated buckle strap receiver; and a buckle operably coupled to the second end of the buckle strap for engaging an anchor on an opposing portion of the footwear upper.

9 Claims, 9 Drawing Sheets

U.S. PATENT DOCUMENTS

| | | | | | |
|---|---|---|---|---|---|
| 3,744,158 | A | | 7/1973 | Walker | |
| 3,783,534 | A | | 1/1974 | Phillips et al. | |
| 3,906,645 | A | | 9/1975 | Heckel | |
| 4,062,133 | A | | 12/1977 | McGee et al. | |
| 4,095,356 | A | | 6/1978 | Robran et al. | |
| 4,267,651 | A | | 5/1981 | Albano | |
| 4,542,597 | A | | 9/1985 | Baptista et al. | |
| 4,563,825 | A | | 1/1986 | Tesser | |
| 4,587,749 | A | | 5/1986 | Berlese | |
| 4,670,946 | A | | 6/1987 | Olivieri | |
| 4,693,021 | A | | 9/1987 | Mazzarolo | |
| 4,882,858 | A | | 11/1989 | Signori | |
| 5,109,613 | A | | 5/1992 | Van Dyke | |
| 5,172,454 | A | * | 12/1992 | Martignago | 24/68 SK |
| 5,234,230 | A | | 8/1993 | Crane et al. | |
| 5,438,769 | A | | 8/1995 | Mazzarolo | |
| 5,495,683 | A | | 3/1996 | Miotto et al. | |
| 5,678,833 | A | | 10/1997 | Olson et al. | |
| 5,720,084 | A | | 2/1998 | Chen | |
| 5,842,293 | A | | 12/1998 | Young | |
| 5,845,371 | A | * | 12/1998 | Chen | 24/71 SK |
| 5,884,370 | A | | 3/1999 | Bergamin | |
| 5,909,850 | A | * | 6/1999 | Cavasin et al. | 24/71 SK |
| 6,038,791 | A | * | 3/2000 | Cornelius et al. | 36/115 |
| 6,347,436 | B1 | * | 2/2002 | Barber et al. | 24/68 SK |
| 6,536,138 | B1 | * | 3/2003 | Miralles | 36/50.1 |
| 6,691,434 | B1 | | 2/2004 | Couturier | |
| 6,826,853 | B1 | | 12/2004 | Zanatta | |
| 2004/0226195 | A1 | | 11/2004 | Martinez | |
| 2007/0101616 | A1 | | 5/2007 | Munns | |
| 2007/0118975 | A1 | | 5/2007 | Munns | |

FOREIGN PATENT DOCUMENTS

| | | |
|---|---|---|
| GB | 2045598 | 11/1980 |
| JP | 03184501 | 8/1991 |

OTHER PUBLICATIONS

Fox MX Spring Additions 2005—Product Catalog; Copyright 2005; Fox Racing, Inc. Morgan Hill, California; p. 40 (2 pages total).

FOX 2006—Product Catalog; Copyright 2005; Fox Racing, Inc. Morgan Hill, California; pp. 49, 75, and 84 (4 pages total).

U.S. Office Action dated Nov. 24, 2008 issued for related U.S. Appl. No. 11/458,068, filed Jul. 17, 2006, 8 pages.

U.S. Office Action dated Oct. 23, 2008 issued for related U.S. Appl. No. 11/458,027, filed Jul. 17, 2006, 12 pages.

US Office Action dated Sep. 8, 2010 issued for related U.S. Appl. No. 12/366,571 (17 pages).

* cited by examiner

INTEGRATED BUCKLE STRAP RECEIVER FOR FOOTWEAR

RELATED APPLICATIONS

This application claims priority to U.S. Provisional Patent Application No. 60/735,302, filed Nov. 10, 2005, by Jon Munns, entitled ARTICLE OF FOOTWEAR and is related to applications U.S. application Ser. No. 11/458,027, filed Jul. 17, 2006 now U.S. Pat. No. 7,530,182, by Jon Munns entitled MOLDED GASKET FOR FOOTWEAR and U.S. application Ser. No. 11/458,068, filled Jul. 17, 2006 now U.S. Pat. No. 7,530,183, by Jon Munns entitled FOLD-OVER THERMAL LAMINATE FOR FOOTWEAR, the contents of which are hereby incorporated by reference as if recited in full herein for all purposes.

BACKGROUND

Millions of people around the world use motorcycles not just for transportation, but for recreational activities such as touring and vacationing, off-road exploration, and racing. Motorcycle racing is a multi-billion dollar industry just in North America. Amateur and professional racers compete in thousands of races every year all over Canada, Mexico, and the United States. For example, the American Motorcycle Association® (AMA) organizes racing competitions in six different categories: superbike, flat track, supermoto, motocross, supercross, and hillclimb. Motorcycle riding competitions also feature prominently in extreme sports competitions, such as the X Games® or the Dew Sports Action Tour™ competitions. Additionally, motorcycles and motocross have inspired or melded with other types of vehicles to create new forms of all-terrain vehicle (ATV) recreation, including quad racing, competitive snowmobile racing, and bicycle motocross (BMX).

Protective gear is a critical component for amateur and professional motorcycle enthusiasts, and manufacturers often tailor such equipment for specific uses. Off-road motorcycle riding and racing present unique challenges for protective riding gear. Not only must the equipment protect riders in the case of a fall, it must function in the face of unique hazards not seen in road riding or track racing. In all types of off-road motorcycle riding and racing, riders often face treacherous riding conditions while traveling over dirt, sand, mud, and snow. Off-road riders often must negotiate around trees and stumps, boulders, brush, and other terrain features. Not only must a rider's protective gear protect him from such risks of injury, that equipment should be able to structurally withstand being struck by such objects without failing. In wet or snowy conditions, riders often become covered in mud, which can interfere with attachment mechanisms on protective equipment.

The legs of an off-road rider in particular face a variety of hazards presented by flying objects (e.g., rocks, clumps of mud, sand, and branches), kicked-up by the rider's own vehicle and by other riders, as well as terrain features. Even on relatively smooth dirt tracks, the risk of lower leg or foot injury for flying objects may be substantial. Additionally, motorcycle riders expect their boots to protect them from hazards presented by the bikes they ride or those of other riders. In the case of a fall or a collision, a rider's leg may become pinned under the motorcycle, and even while riding, heat from engine and exhaust components presents a burn risk to an unprotected rider.

In view of the forgoing, there is an ever-present need for improved protective footwear for motorcycle and other off-road motorsports that protects a rider's lower legs and feet against reasonably anticipated risks and hazards that the rider might face. Additionally, there is an ever-present need to simplify the construction of such protective footwear and to reduce production costs.

Prior art motorcycle and motocross boots employ multi-part attachment systems for securing the boots to the rider's feet and legs. FIGS. 12 and 13 illustrate a typical prior art attachment system 700 where a buckle 702 and buckle strap 704 form one part of the system and an overstrap 706 and securing plate 708 form another part of the system that receives the buckle strap 704. The securing plate 708 functions to receive and engage the buckle strap 704, holding it in place. Typically the securing plate and strap have a set of complementary engageable structures such as teeth 728. The securing plate is itself coupled to a flap on an item of footwear via overstrap 706.

The securing plate 708 is snapped into an aperture 720 defined within the first end 722 of the overstrap 706 and is held in place by an interference fit between the two parts. The edge 725 of the aperture becomes a seam between the securing plate 708 and overstrap 706. The first end 714 of the buckle strap 704 is passed through a slot 730 in the securing plate 708, while second end 716 of the buckle strap 704 is coupled to the buckle 702. The attachment system 700 is fully engaged when the buckle 702 is engaged with an anchor point (not shown) on the boot (not shown). Buckle 702 includes an elongated member 750, having a first end 752 and a second end 754, and buckle lever arm 760, having a first end 762, a second end 764. The first end 762 of the buckle lever 760 comprises an anchor-receiving depression or seat 768, and the second end 764 of the buckle lever arm 760 comprises a flange 769. The buckle lever arm 760 rotates around a transverse buckle pivot 780 operably coupled to the elongated member 750, and the buckle 702 engages the anchor (not shown) in a manner similar to that described below.

While this system adequately secures the boot to a wearer's leg, some problems do exist with this traditional attachment system. For example, the mechanical bond created between the securing plate and the overstrap can fail if the tensile load on the system exceeds the strength of the unified securing plate/overstrap structure. The system can accumulate dirt and debris in the gaps and spaces around the individual parts, including in the interface between the securing plate and the overstrap and around the portion of the buckle strap extending through the securing plate and underneath the overstrap. This traditional multi-part system can be prone to wear or failure if one of the multiple parts is damaged or worn down. Additionally, the overall system is rather bulky and can create a pressure point in the boot that causes the wearer to experience some discomfort. Still further, it requires multiple production steps to produce and assemble the various parts.

U.S. Pat. No. 5,884,370 discloses an example of a traditional attachment system for motorcycling and motocross boots as well as other sports shoes. One stated aim of the patent is to provide a "lever which is structurally simple, has low costs, and remains in the closed position even if the lever arm or the toothed band are subjected to impacts against blunt objects." This patent describes a band (15) associated with an adapted engagement element (16) mounted on a second flap (3). The engagement element and second flap together constitute a buckle strap receiver. The patent states that the "engagement element is internally hollow so as to allow to insert therein the free end of the band," and the band and the engagement element have complementarily shaped teeth for locking the band into place. Most significantly, base elements (16) is attached to flap (3) by stitching only. Therefore, this buckle strap receiver is a non-unitary, two-part system, which suffers from some or all of the aforementioned problems.

In view of the forgoing, there is a need for improved attachment systems that are stronger, more reliable, and simpler and less expensive to produce and assemble.

SUMMARY

The inventive subject matter overcomes problems in the prior art by providing a footwear attachment system that includes an integrated buckle strap receiver that addresses the aforementioned problems in traditional attachment systems. This attachment system has an integrated buckle strap receiver comprising an overstrap and securing plate having a unitary construction. The inventive subject matter also contemplates methods of making the inventive attachment system and components or assemblies thereof, and footwear with the inventive attachment system.

These and other embodiments are described in more detail in the following detailed descriptions and the figures. The foregoing is not intended to be an exhaustive list of embodiments and features of the inventive subject matter. Persons skilled in the art are capable of appreciating other embodiments and features from the following detailed description in conjunction with the drawings.

DETAILED DESCRIPTION

Figure 12:
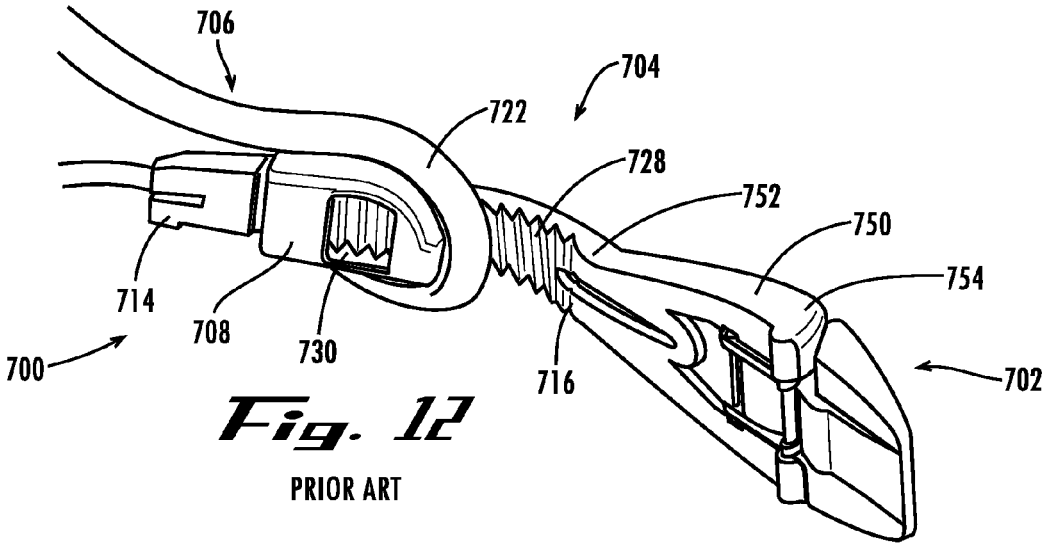
Fig. 12 PRIOR ART
FIG. 12 is a close-up perspective view of a prior art buckle strap receiver system, composed of an overstrap and securing plate, engaging a buckle strap.
Figure 13:
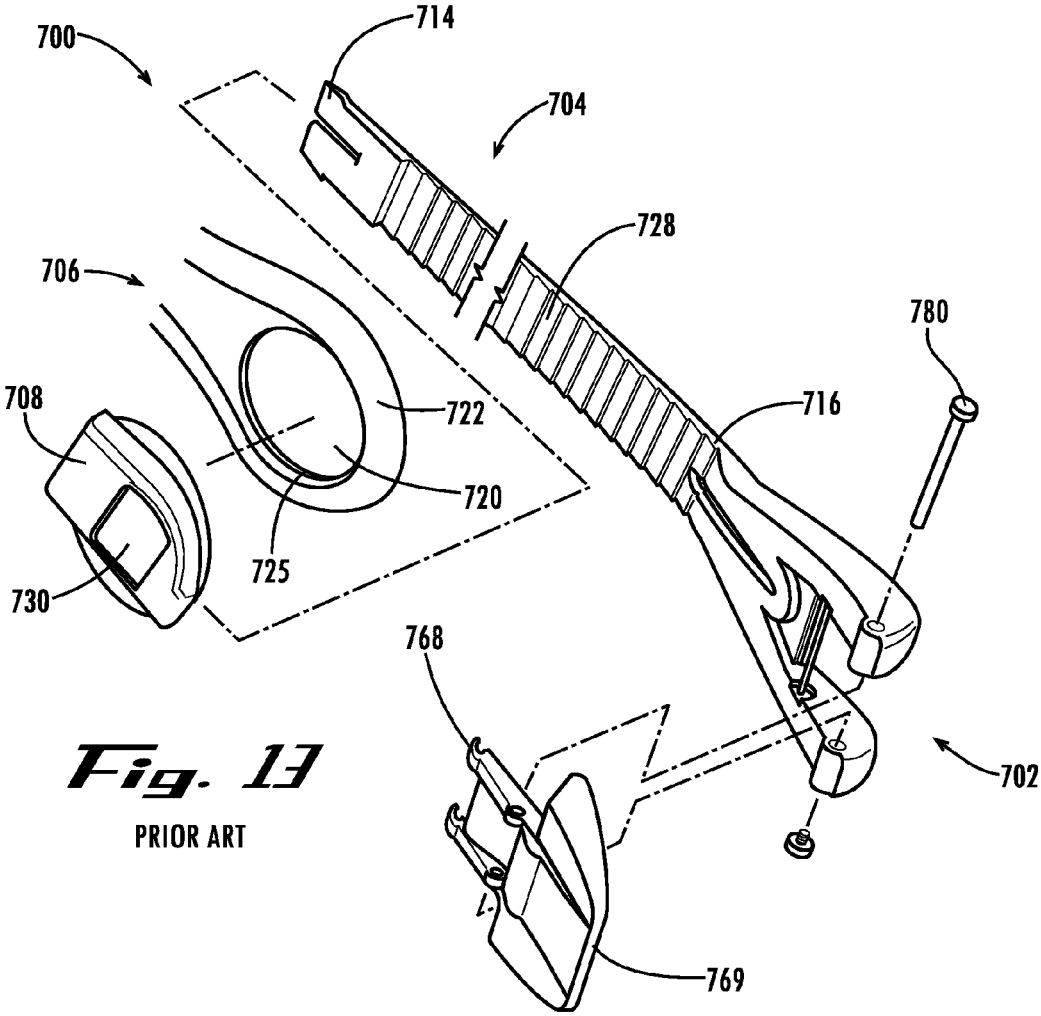
Fig. 13 PRIOR ART
FIG. 13 is an exploded view of FIG. 12.

Representative embodiments of the inventive subject matter are shown in FIGS. 1-11 with similar features indicated by common reference numerals. FIGS. 12-13 illustrate a prior art attachment system.

An Exemplary Motocross Boot

FIGS. 1-4 illustrate a motocross boot utilizing the molded top gasket, fold-over thermal laminate, and other inventive features. While the following description relates to the illustrated boot, the inventive attachment system disclosed herein (and other inventive features) may be embodied in protective footwear for other uses, including (but not limited to) supercross, snowmobile racing or riding, motocross freestyle and trick riding, or recreational off-road motorcycle, quad racer, or other ATV riding, for example, as well as on footwear unrelated to motorsports, such as ski boots, in-line and ice skating boots, etc.

The illustrated motocross boot 10 has a sole unit 20 and an upper 30. The sole unit 20 and upper 30 may be disposed on: a front-rear axis running between the toe of the boot and the heel (which may be considered an X-axis); a top-bottom axis running between top of the boot that circles the calf of the wearer just below the knee and the bottom of the boot (which may be considered a Y-axis); and a medial-lateral axis running between the left side (inside) and right side (outside) of the boot (which may be considered a Z-axis).

The sole unit 20 provides a platform for the foot and may be composed of any material providing suitable stiffness and protection, including plastics, rubbers (including cured or vulcanized rubbers), natural or synthetic compressed leather, or combinations thereof, including laminated sole units having layers of different materials. Optionally, a metal plate (not shown) may be sandwiched within layers of the sole unit, a layer of compressible sponge or foam material (such as spongy ethyl vinyl acetate) can be added within the sole, and/or a metal toe plate 22 may be mounted on the front toe area of the sole. This toe plate offers additional protection and facilitates shifting and other controls of the motorcycle while riding.

The upper 30 is attached to the sole unit and extends upwardly therefrom and wraps around at least a portion of the lower leg of a wear. It has an opening 31 for receiving a wearer's foot when the boot 10 is secured to a wearer's leg. The boot 10 typically is sized to receive the wearer's foot, ankle, and at least a portion of the wearer's lower leg. The upper 30 includes a top edge portion that defines both the opening 31 and a transverse plane that is substantially perpendicular to the Z-axis of the boot 10. This transverse plane also is substantially parallel to the X-axis and Y-axis of the boot 10. When the boot is worn, this transverse plane intersects a portion of the wearer's lower leg through the tibia and fibula that is inferior to the knee joint and superior to the ankle. In particular embodiments, this transverse plane intersects the wearer's lower leg through the superior half of the tibia and fibula.

The upper 30 may include several different components that serve functional or protective needs of a wearer: an impact shield 32, an attachment system 34, optional design indicia 36, a toe/instep control area 38 for contacting the motorcycle (e.g., controlling the shift lever), a foot/leg encasement 40, a protective heel plate 42, a thermal laminate 100, and a top gasket 200. Any suitable material that provides the minimum physical characteristics may be used to construct each part of the upper; the following descriptions of suitable materials are presented for exemplary purposes only and should not be interpreted as providing an exhaustive range of suitable materials. Combinations of these materials may be used in constructing various parts of the motorcycle boot as well.

The impact shield functions as a protective layer or shield that reduces the risk of a wearer suffering injury if he is struck by a flying object, collides with another rider, accidentally falls of a motorcycle, or suffers some other trauma to the legs. The impact shield need not cover or surround the entire upper, or even a major portion of the upper, and while the impact shield forms the outer layer of the upper in many embodiments, the shield alternatively may form a different layer of the upper. Suitable materials for constructing the impact shield include: hard yet flexible thermoplastics, rubbers, elastomers, and other polymers such as PE (polyethylene), HDPE (high density polyethylene), high impact polypropylene, TPU (thermoplastic urethane), Ortholite™ Rubthane, and different nylon formulations; metals or alloys, such as aluminum, stainless steel, steel, and tungsten; or woven fabrics (including blended fabrics), laminates, or composites, such as Kevlar®, ballistic nylon, carbon fiber, and fiberglass. In selected embodiments, a dual-density or dual-durometer shield is constructed from at least two different materials having different densities or hardness ratings. For example, the shin guard portion of the shield (covering the shin of the wearer) may be made from a harder, denser material like TPU while portions intended for control or manipulation of the motorcycle may be made from a softer, less dense material like Rubthane.

The attachment system secures the footwear to the wearer's foot and at least a portion of the wearer's lower leg above the ankle. The inventive attachment system is described in further detail below.

Design indica are intended to provide an aesthetic look to the finished product, create a brand for the product, and/or identify the source of the product in the minds of consumers. Suitable materials for such indicia include: rigid thermoplastics, such as PVC (polyvinyl chloride), PS (polystyrene), fine mold TPU (thermoplastic urethane), and metals or alloys, such as aluminum, steel, tungsten, or nickel. In selected embodiments, the indicia are partially or completely chrome plated.

The toe/instep control area provides a moderate to high friction surface in the front area of the boot to facilitate operation and control of the motorcycle (or other motor vehicle), and the toe/instep control area may be softer than the underlying base material. Suitable materials for manufacturing the to/instep control area include: elastomers, rubbers, and thermoplastics such as LDPE (low density polyethylene), neoprene, polychloroprene latexes, chlorosulfonated polyethylene synthetic rubber, ethylene octene copolymers, and EPDM (Ethylene Propylene Diene Monomer).

The foot/leg encasement typically forms the innermost layer of the upper that encloses the wearer's foot and leg. It may include cushioning to provide a softer, more comfortable, adjustable fit. The encasement may be made from natural or synthetic fabrics or technical textiles (including blends and treated or coated fabrics and materials), such as natural or synthetic leather, polyethylene coated leather, cotton, polyester, nylon, rayon, spandex and other polyurethane-based elastane textiles, flexible polyurethane foams, cotton batting, latex foam, Biofoam™, and impact-reducing gels. In selected embodiments, the encasement includes air pockets or chambers to further reduce shocks and impacts.

The heel plate is intended to provide an additional layer of protection (in addition to the impact shield) over the heel and lower leg area, such as over the Achilles tendon. Suitable materials for the heel plate include: rigid thermoplastics, such as PVC (polyvinyl chloride), PS (polystyrene), TPU (thermoplastic urethane); and metals or alloys, such as aluminum, stainless steel, tungsten, and nickel.

The thermal laminate 100 (which is also known in the industry as a "burnguard") is a protective layer and thermal insulator intended to help protect the boot and the wearer from heat-related damage or injury. Suitable materials for the burn guard include: natural or synthetic leathers, such as suede leather; woven natural or synthetic fabrics (including blended, coated, or treated fabrics) including ceramic textiles and textiles containing carbon fiber or aramid (aromatic polyamide), meta-aramid, or para-aramid fibers, such as Nomex® or Kevlar®; natural and synthetic rubbers and elastomers such as: polychloroprene, chlorosulfonated polyethylene, perfluoroelastomers, ethylene octene copolymers, EPDM, polychloroprene latexes, and other polyolefins; or plastics and other polymers, such as mylar, PU, and LDPE.

The top gasket 200 is intended to provide a seal that at least partially separates the inside of the boot from the external environment when the boot is worn. The gasket is intended to provide a barrier protecting the interior of the boot against substances or objects (e.g., dirt, sand, mud, snow, rocks, debris). Suitable commercially available elastomeric materials include natural or synthetic rubbers, such as neoprene, latex rubber, silicone rubber, and Rubthane.

Mixtures of the materials mentioned herein also may be used including (but not limited to) fiberglass reinforced nylons or carbon fiber and Kevlar® blends. Any of these materials may be altered, coated, or otherwise treated with an additive, such as a pigment or coloring agent; emulsifiers; reinforcing agents; antimicrobial agents; flame retardants; or thermal insulators. Additionally, the shape or surface of any boot component may be altered for aesthetic or functional purposes, including (but not limited to) molding, shaping, texturing, scoring, painting, printing, stamping, pressing, and embroidering.

The impact shield 32 is a hard protective shell that preferably still provides sufficient flexibility for a wearer to put on and remove the boot. The following describes a typical construction for a shield in a motocross boot.

The top portion of the impact shield 32*a* may substantially surround the entire upper portion of the wearer's lower leg (e.g., the portion of the lower leg where the superior portions of the calf muscles attach to the superior portions of the tibia and fibula adjacent to, but inferior to, the lower portions of the knee joint and patella region).

Only some small areas over medial and medial-anterior sections of this region of the wearer's lower leg are not covered by the hard plastic impact shield, although (as described below) these areas are still protected by the leg/foot encasement of the boot. The conformations and arrangements of the shield and encasement are designed to provide lateral strength and stability (along the Z-axis) while still allowing sufficient flexion of the foot (along the X-axis). The top-most buckle strap 450*a* may be coupled to the top portion of the impact shield 32*a* via buckle strap receiver 550*a*.

The middle portion 32*b* of the impact shield 32 may substantially cover the anterior, posterior, and lateral sides of the wearer's lower leg (FIGS. 1, 2, and 4) to an area just superior to the wearer's ankle. In the illustrated embodiment, the impact shield 32 only partially extends into and covers areas corresponding to the lateral side of the wearer's lower leg and upper ankle (i.e., the inferior portions of the tibia and fibula where these bones interact with the superior extensions of the ankle bones). The middle buckle strap 450*b* may be coupled to this middle portion of the impact shield via buckle strap receiver 550*b*.

The lower portion 32*c* of the impact shield 32 may substantially surround the medial and lateral sides of the wearer's foot and ankle (FIG. 4) as well as the wearer's heel and toes (FIGS. 1-4). The medial side of the lower portion of the impact shield may substantially cover the heel, ankle, and toes (FIG. 3), but the area that would otherwise cover the wearer's lateral side of the upper ankle/lower leg (where the inferior ends of the tibia and fibula interact with the superior extensions of the ankle bones), and superior top of the foot may be left open. The lower-most buckle straps 450*c* and 450*d* may coupled to this lower portion of the impact shield via buckle strap receivers 550*c* and 550*d*.

The gaps or open areas of the boot upper not covered by the impact shield typically are not as prone to environmental injury (from flying objects, obstructions, contact with the motorcycle, and the like) while a wearer is riding a motorcycle. Leaving these areas of the boot upper open-—rather than being covered by additional portions of the impact shield—facilitates flexion of the foot during riding and reduces excess weight of the boot. Foot and leg movement may be an important part of controlling motorcycle operation, so this balance between providing hard, but less flexible, protective surfaces and flexible, but less protective, areas that facilitate foot movement may be an important consideration in designing any protective motocross boot. Additionally, excess weight of any protective gear, including motocross boots, may adversely affect a wearer's performance during use, particularly during strenuous competitive or recreational activities such as motocross racing or off-road motorcycle riding. Accordingly, in view of the forgoing, person skilled in the art may vary areas of coverage to meet particular design considerations.

Indicia 36*a-c* are aesthetic designs made of hard plastic, metal, or other materials. These indicia may provide additional protection to the wearer, but are primarily intended to identify the product through recognizable shapes, symbols, colors, or other sensory cues. As just one example, the indicia 36*a-c* used on the illustrated embodiment of the boot (FIGS. 1-6) are the trademarked symbols of Fox Racing, Inc.® (Morgan Hill, Calif.).

The toe/instep control area 38 may be a layer of lower density plastic or polymers on the outer surface of the underlying hard plastic impact shield 32*c* which offers greater friction for a better grip while interacting with various surfaces and controls on the motorcycle, such as portions of the frame, foot-operated shifting levers, and foot pegs. Optionally, the toe/instep may be textured or contoured to enhance such interactions.

Encasement 40 typically is located inside the impact shield 32 and encases the wearer's foot and lower leg. The encasement may be constructed to enhance the wearer's comfort during use while still offering at least a minimal degree of protection against the risks of impact injuries caused by falling, collisions, flying rocks or other objects, or environmental obstructions. As just one example, encasement 40 may be constructed from an outer layer of heavy synthetic or natural leather and an inner layer of spandex or Lycra® that both sandwich a layer of compressible foam.

Heel plate 42*a-b* typically is a flat protective member mounted on the outside of the upper, which provides additional protection to the heel, ankle, and inferior posterior portions of the wearer's lower leg.

The Attachment System and Integrated Buckle Strap Receiver

The inventive attachment system with an integrated buckle strap receiver differs significantly from traditional attachment systems, a typical example of which is illustrated in FIGS. 12 and 13. In traditional attachment systems, the buckle strap is secured by a two-part buckle strap receiver composed of an overstrap and a securing plate. U.S. Pat. No. 5,884,370 also describes such a two-part buckle strap receiver composed of an adapted engagement element (16) (i.e., a securing plate) mounted on a second flap (3) (i.e., an overstrap). In contrast, the integrated buckle strap receiver has a single, unitary construction that receives and retains the buckle strap.

The integrated buckle strap receiver provides superior mechanical engagement for the buckle strap because the integrated buckle strap receiver is formed from two portions chemically bonded to one another to form a unitary piece (such as being formed into a unitary piece through a co-molding process or otherwise physically fused together). In contrast, traditional attachment systems with a two-piece overstrap/securing plate combination rely solely on a mechanical connection between these two separate pieces. Thus, the integrated buckle strap receiver provides a much higher tensile strength than the traditional overstrap/securing plate combination.

The unitary integrated buckle strap receiver also has fewer seams and part lines (compared to traditional systems) that would otherwise allow dirt and debris to become lodged in the attachment system. Additionally, the integrated buckle strap receiver may be less bulky, may provide a lower profile, and may offer a better packaged solution for improved fit and reduced pressure point discomfort, compared to traditional attachment systems.

The illustrated attachment system 34 is pictured and described in relation to a motocross boot. The attachment system may be used with any other type of footwear, though it may be particularly useful with protective footwear intended for use with a motorized or non-motorized vehicle, or other boot systems, such as ski boots or skates, where opposing portions of an upper (which may be referred to herein as "flaps") need to be pulled together under relatively high tension.

Figure 1:
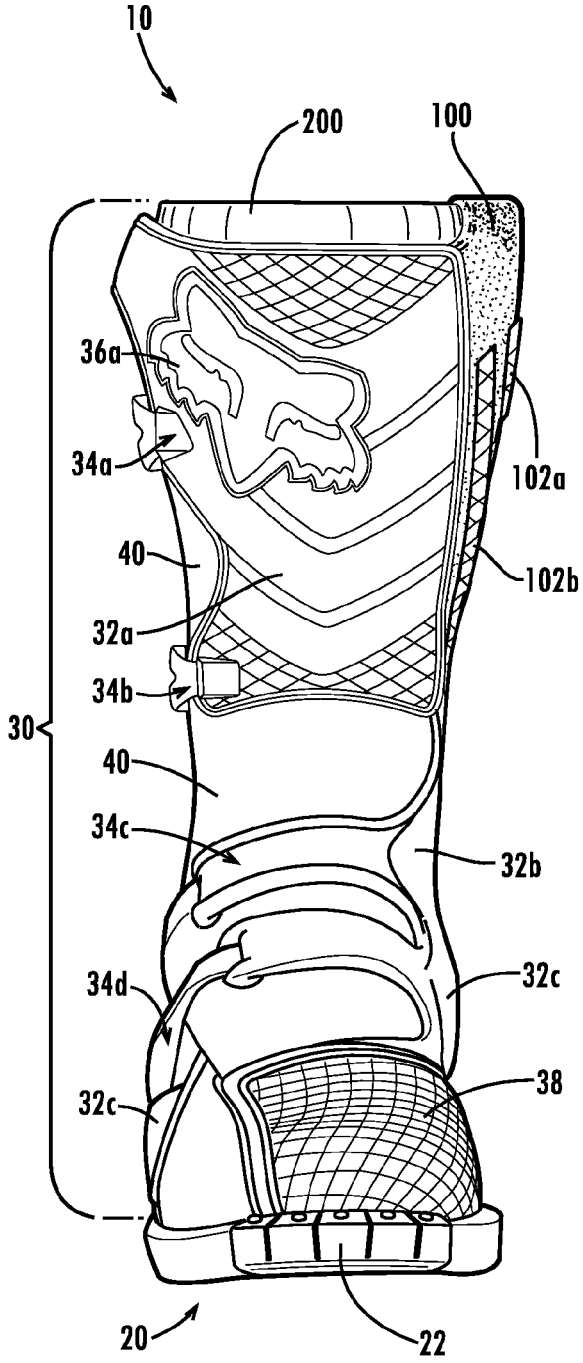
FIG. 1 is a front view of one embodiment of a motocross boot illustrating an embodiment of the attachment system utilizing integrated buckle strap receivers according to the inventive subject matter disclosed herein. This particular motocross boot is intended for the right foot of a wearer.
Figure 2:
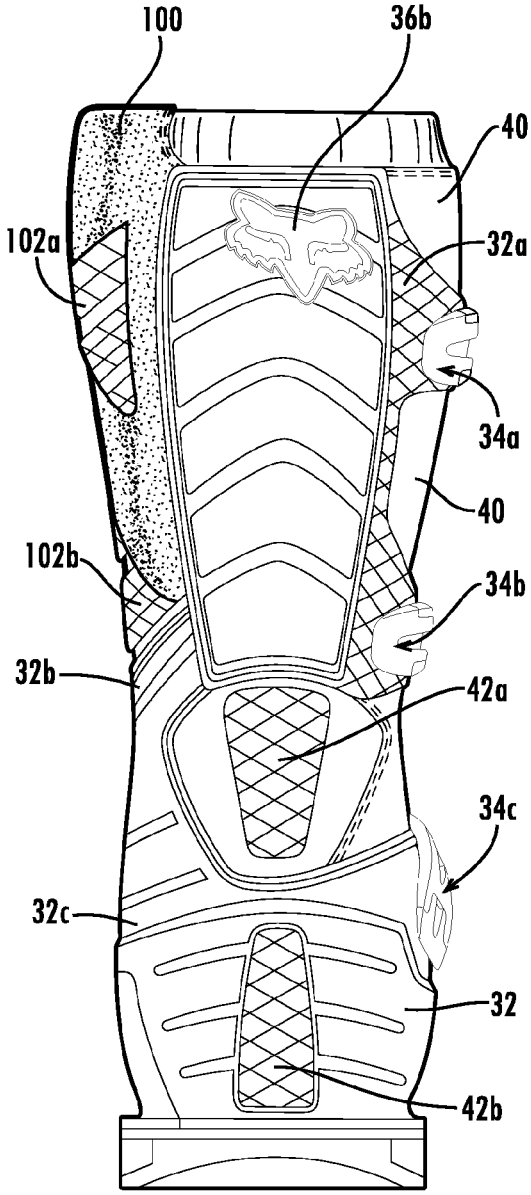
FIG. 2 is a rear view of the boot shown in FIG. 1.
Figure 3:
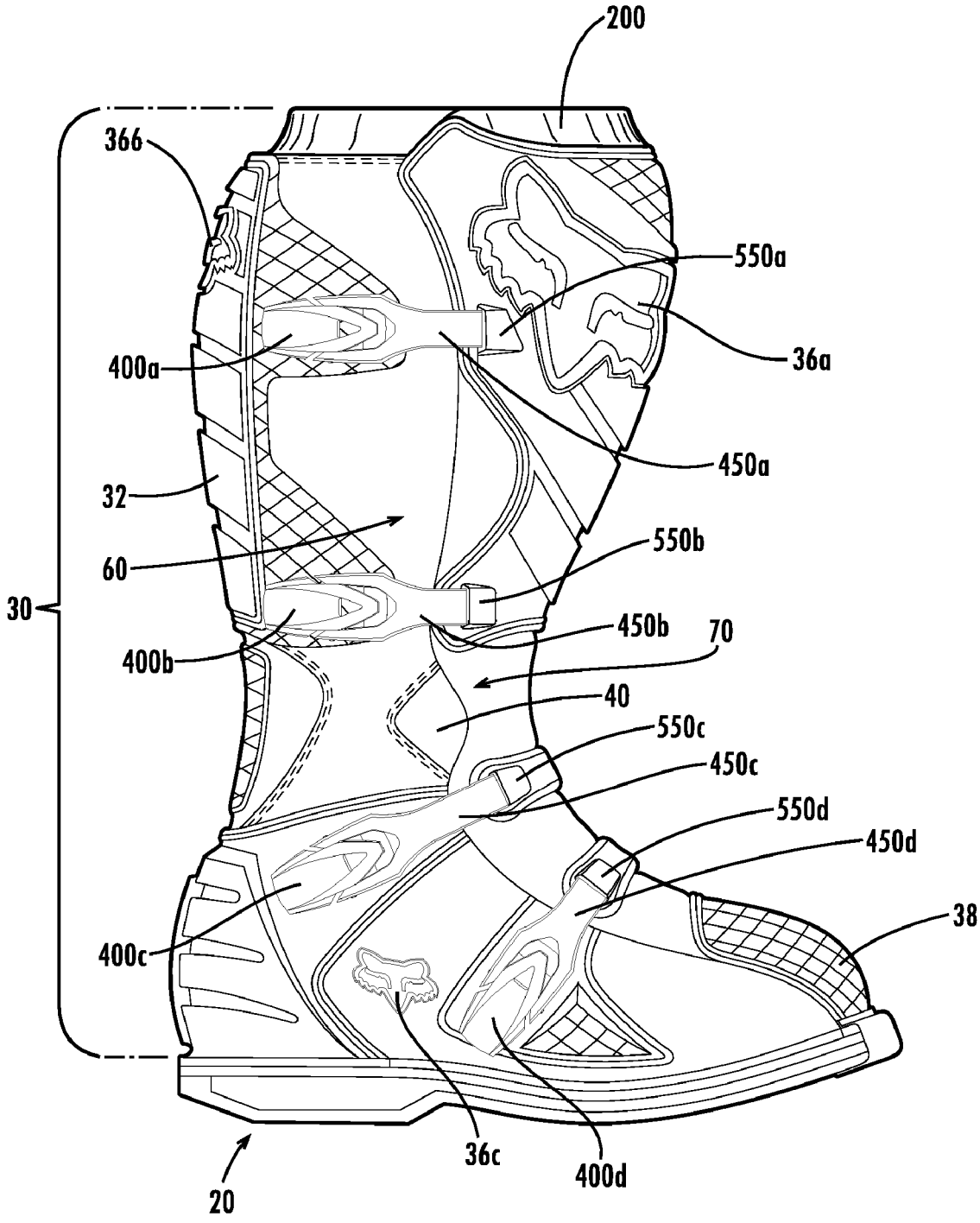
FIG. 3 is a right (lateral) side view of the boot shown in FIG. 1.
Figure 4:
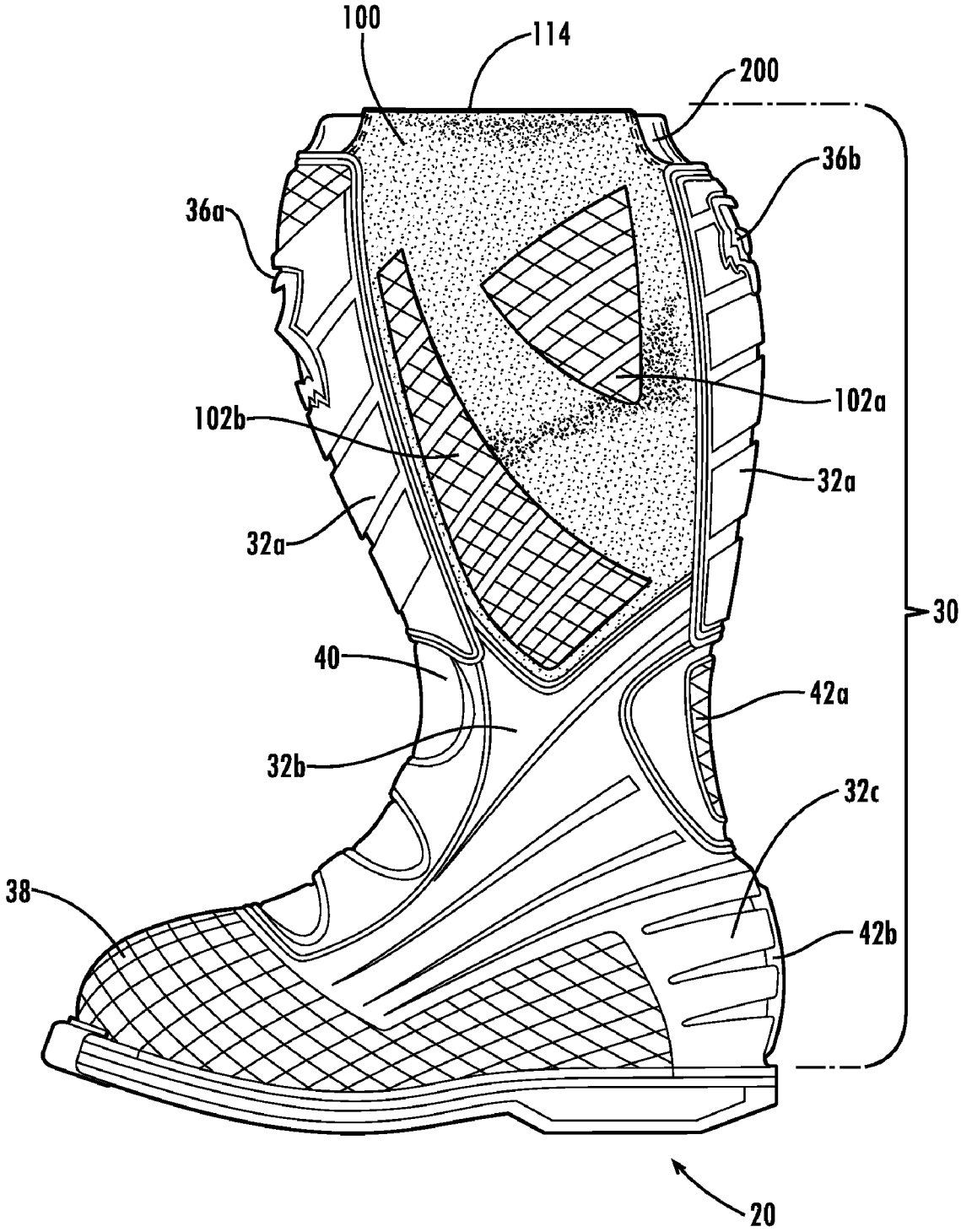
FIG. 4 is a left (medial) side view of the boot shown in FIG. 1.
Figure 5:
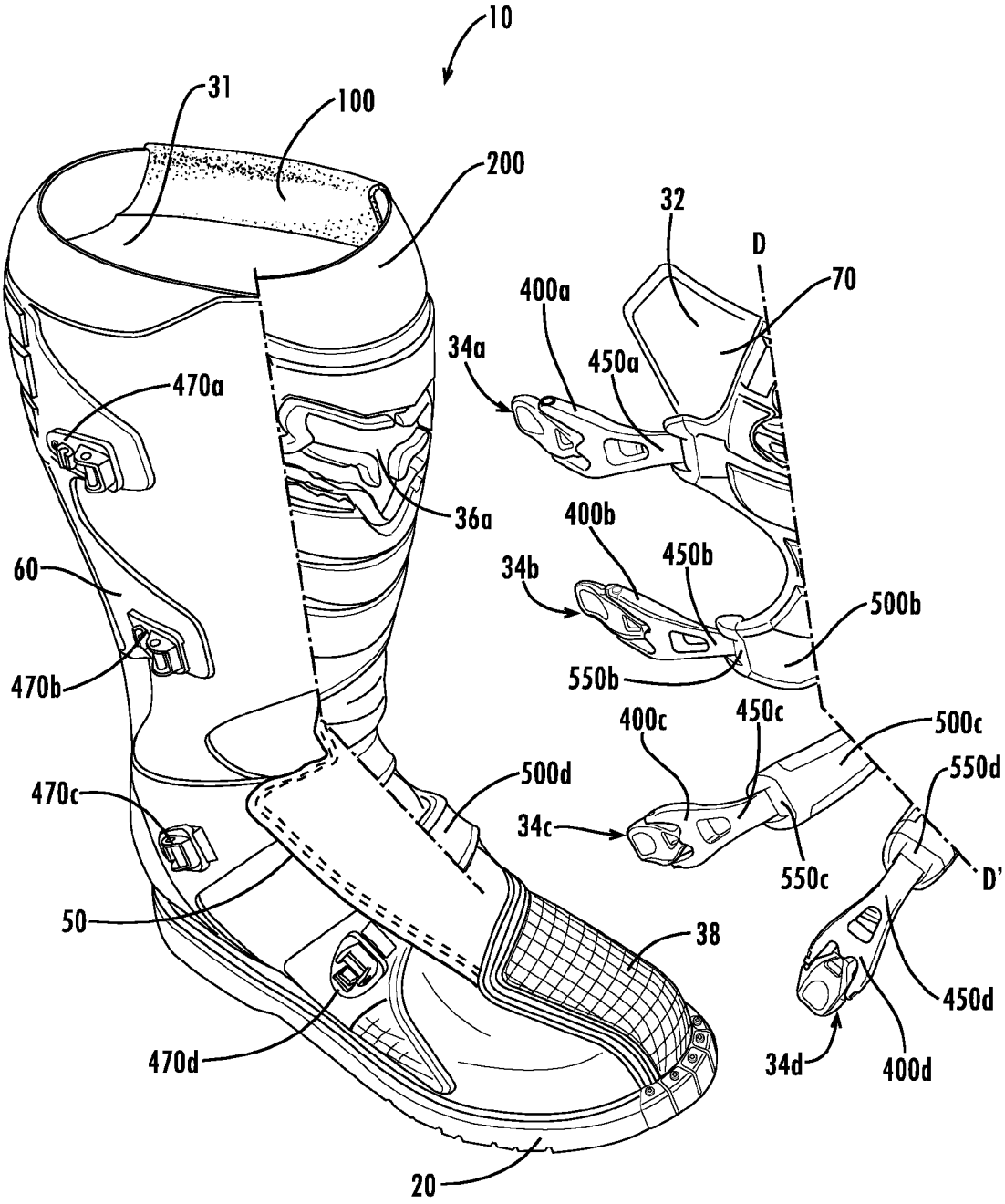
FIG. 5 is an exploded perspective view of the right side of the boot illustrated in FIGS. 1-4 with the buckles and buckle straps coupled to their corresponding integrated buckle strap receivers. The buckles are shown separate from their anchor points however.
Figure 6:
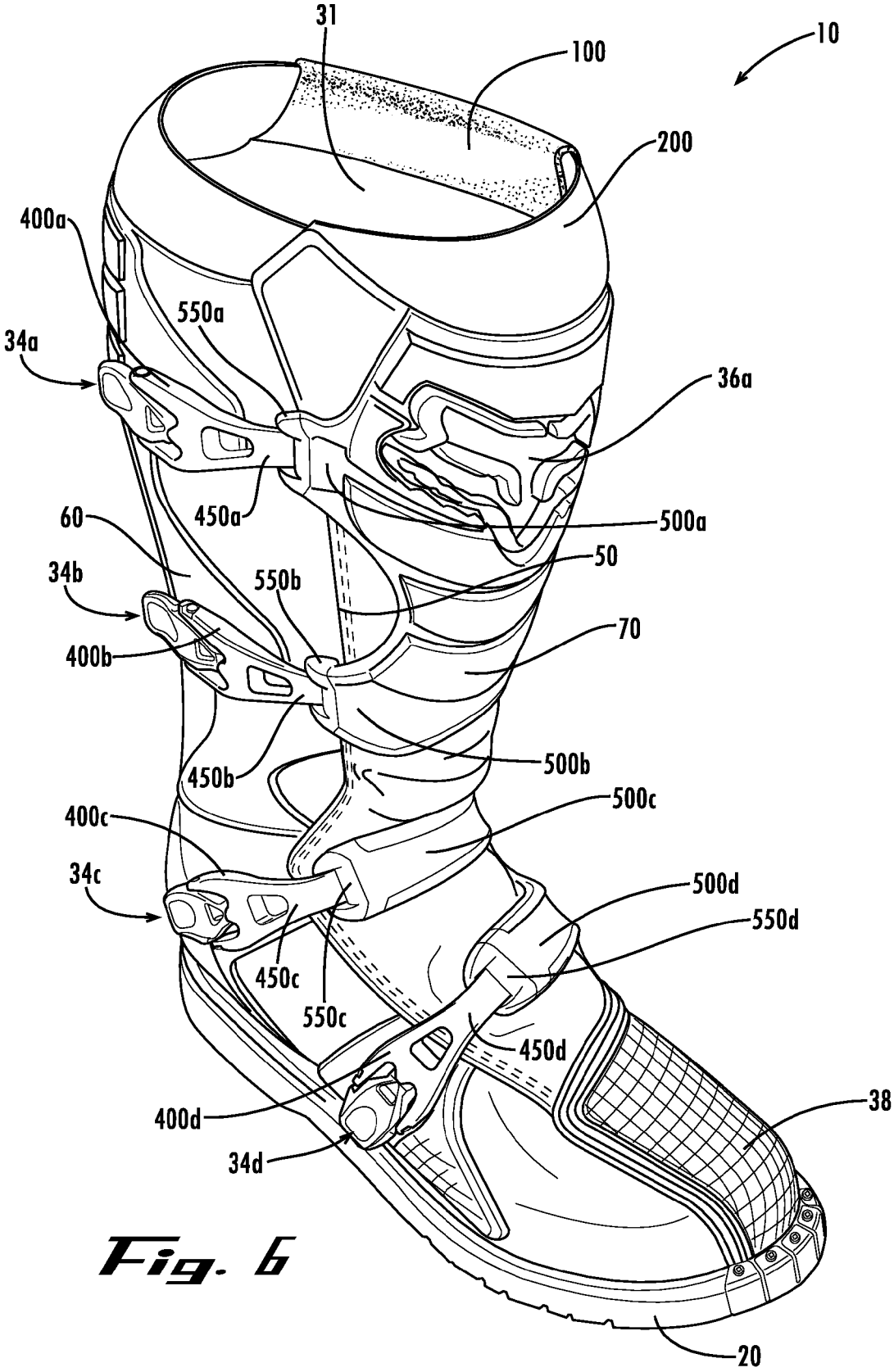
FIG. 6 is a perspective view similar to FIG. 5, but with the attachment system shown fully engaged with the buckles attached to their anchor points.
Figure 7:
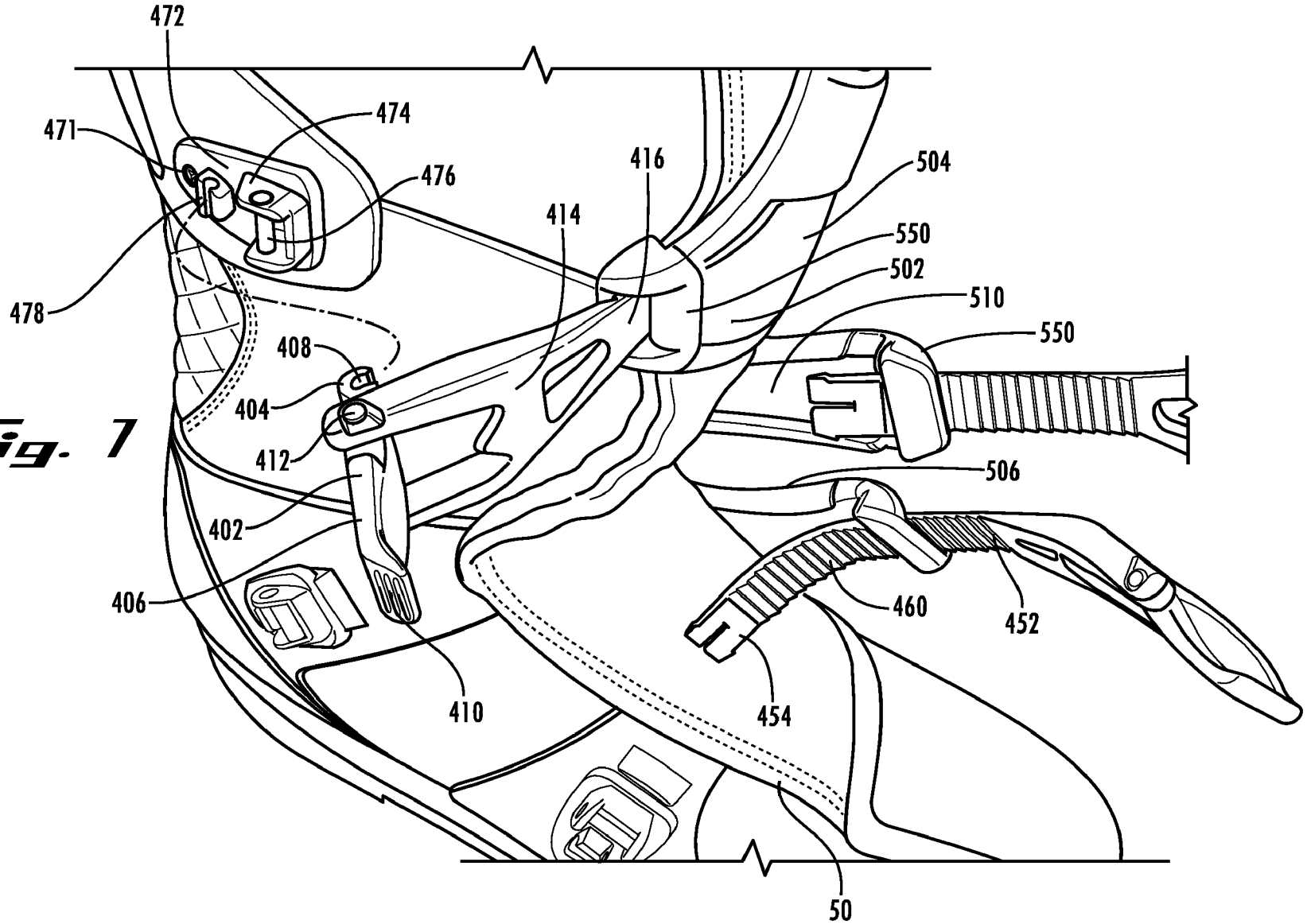
FIG. 7 is a close-up perspective view of three buckles of attachment system shown disengaged from their anchor points.

FIGS. 5-11 are directed to illustrating particular components of an attachment system 34 and their arrangements and relationships. As shown in FIG. 5 (as well as FIGS. 1-4), the attachment system 34 may be provided in one or more sets along one or more flaps for an upper, with the components generally divided from a boot flap 70 along dashed line D-D' for illustrative purposes. Alternative embodiments of the attachment system may use a different number of sets. For example, an alternative embodiment could have two, three, five, six, seven, eight, nine, ten, or more sets of attachment systems spaced along opposing flaps. A set of components for an attachment system 34 includes at least a buckle 400, buckle strap 450, overstrap 500, and integrated buckle strap receiver 550. The system also may include a buckle anchor 470 for engaging buckle 400.

The attachment system helps secure the boot to a wearer's foot and leg. It preferably includes an adjustable strap. The upper 30 of the boot 10 includes a split or seam 50 that divides the upper 30 into a first flap 60 and a second flap 70. The wearer can pull apart these flaps 60, 70 when inserting her foot (not shown) into the upper 30 through upper opening 31. The boot may be secured by closing these upper portions 60, 70 against each other and locking a buckle 400 onto buckle anchor 470 (located on the second flap 70) when the buckle strap 450 is engaged with the integrated buckle strap receiver 550 of the overstrap 500 (coupled to the first flap portion 60). Securing the boot to the wearer's body may be accomplished by locking down all, some, or one of the buckles of the attachment system, which places the opposing flap under tension.

Buckle 400 and buckle anchor 470 may be any suitable devices, including traditional buckles and buckle anchors already known and used in protective footwear. As just one example, the buckle, anchor, and lever system described in U.S. Pat. No. 5,884,370—or other similar buckles—may be adapted for use with the disclosed attachment system 34.

Buckle anchor 470 is disposed on the second flap 70 of upper 30. It is an anchor point that removably and lockingly receives an opposing buckle. In some embodiments, the second flap 70 of the upper 30 may be a portion 72 of the protective plastic shell 32. The anchor may be glued or bonded onto the second flap of the upper, or the anchor may be mechanically fixed to the second flap via bolts, rivets, snaps, screws, stitching, staples and the like. In the illustrated embodiment, buckle anchor 470 is secured by screw 471. Anchor 470 can rotate around screw 471 to facilitate adjustment and fitting of the attachment system.

The anchor 470 may include a base 472 and two protruding wings 474*a* and 474*b* extending outward from the base 472. Alternatively, the base could be integral with the flap. The protruding wings 474*a* and 474*b* are transversely connected by an anchor pivot 476 that provides an engagement point for the corresponding anchor receiving seat 408 of the buckle 400. Buckle anchor 470 also has a buckle pivot receiver 478.

The buckle 400 includes an elongated member 414, having a first end 416 and a second end 418, and buckle lever arm 402, having a first end 404, a second end 406, a first side 440, and a second side 442. When the buckle 400 is engaged with and locked to the anchor 470, the first side 440 of the buckle lever 402 constitutes the top side or outer surface of the buckle lever arm 402 and the second side 442 constitutes the underside or inner surface of the buckle lever arm 402. The first end 404 of the buckle lever 402 comprises an anchor-receiving depression or seat 408, and the second end 406 of the buckle lever arm 402 comprises a flange 410. The buckle lever arm 402 rotates around a transverse buckle pivot 412 operably coupled to the elongated member 414.

The buckle 400 engages the buckle anchor 470 by snapping the anchor receiving seat 408 of the buckle 400 onto the anchor pivot 476 then rotating the buckle arm 402 to force the buckle pivot 412 into the recessed area of buckle pivot receiver 478. The buckle 400 may be temporarily locked into a closed position with buckle anchor 470 by firmly seating the buckle pivot 412 into the buckle pivot receiver 478. The flange 410 offers a gripping surface for the wearer to hold while attaching the buckle 400 to the buckle anchor 470. A closed and locked buckle 400 that is fully engaged with the buckle anchor 470 offers a secure attachment that resists accidental opening due to vibration, jarring, or physical impact. A wearer may open a closed buckle by pulling the flange 410 away from the anchor base 472 to remove the buckle pivot 412 from the buckle pivot receiver 478. The buckle 400 may be disengaged from the buckle anchor 470 by disengaging the anchor receiving seat 408 from the anchor pivot.

Buckle 470 and buckle anchor 470 may be made from any suitable, rigid material including (but not limited to): rigid thermoplastics, such as PVC (polyvinyl chloride) or PS (polystyrene); metals or alloys, such as stainless steel, brass, aluminum, tungsten, or nickel; and composite materials, such as molded carbon fiber or fiberglass composites. Additionally, combinations of these materials may be used. For example, a buckle could have a lever arm made of metal and an elongated member made from rigid plastic.

Buckle strap 450 is an elongated strap having a first end 452, a second end 454, a first surface 456, and a second surface 458. The buckle strap may be formed from any suitable material including (but not limited to): natural or synthetic leather; natural or synthetic fabrics, such as cotton, hemp, polyester, nylon, rayon, spandex, or blended fabrics; fabrics containing carbon fiber or aramid (aromatic polyamide), meta-aramid, or para-aramid fibers, such as Nomex® or Kevlar® (DuPont Advanced Fibers Systems, Richmond, Va., USA); natural and synthetic rubbers and elastomers such as: polychloroprene, chlorosulfonated polyethylene, perfluoroelastomers, ethylene octene copolymers, EPDM (Ethylene Propylene Diene Monomer), and other polyolefins; or plastics and other polymers, such as LDPE (low density polyethylene), and polychloroprene latexes. In particular embodiments, the buckle strap is produced from an injection molded thermoplastic, such as PE (polyethylene), HDPE (high density polyethylene), or high impact polypropylene.

The first end 452 of the strap 450 is coupled to the buckle 400. In some embodiments, the buckle may be disposed on the strap by tying, gluing, bonding, or mechanically fixing via bolts, rivets, snaps, stitching, staples and the like. In other embodiments, however, the buckle may be co-molded with the buckle strap to create a unitary piece. FIGS. 7-11 illustrate one possible co-molded embodiment. Buckle 400 includes an elongated member 414 with a first end 416 and a second end 418, and the first end 414 may be co-molded with the first end 452 of the buckle strap 450. As described below, this co-molding process fuses the materials used to make the elongated member 414 of the buckle 400 and the buckle strap 450 to chemically bond both into a unitary piece.

The first surface 456 of the buckle strap 450 may include a length adjuster. As just one example, the illustrated length adjuster is a plurality of teeth 460 arranged transversely along part of the width of the buckle strap 450. This set of teeth 460 is adapted to interact in a ratchet-like fashion with the integrated buckle strap receiver 550. The fit provided by the attachment system may be adjusted by lengthening or shortening the amount of the of the buckle strap 450 lying between the buckle 400 and the integrated buckle strap receiver 550 after the second end 418 of the buckle strap 400 is passed through the integrated buckle strap receiver 550.

The integrated buckle strap receiver 550 has a first side 552 and a second side 554. A head 556 on the first side 552 of the integrated buckle strap receiver 550 and a lug 558 on the second side 554 of the integrated buckle strap receiver 550 are separated by a gap 560 adapted to receive the second end 418 of the buckle strap 400. The head and lug are in essence acting as a securing plate (e.g., securing plate 708 in FIGS. 12-13). As the buckle strap 400 is inserted through the integrated buckle strap receiver 550, the head 556 engages and frictionally retains the teeth 460 of the buckle strap 400 by means of a complementary flange 562 extending from the head 556 into the spaces between the teeth 460. In total, the buckle strap receiver merges the functions of the overstrap and securing plate into a unitary structure.

Figure 8:
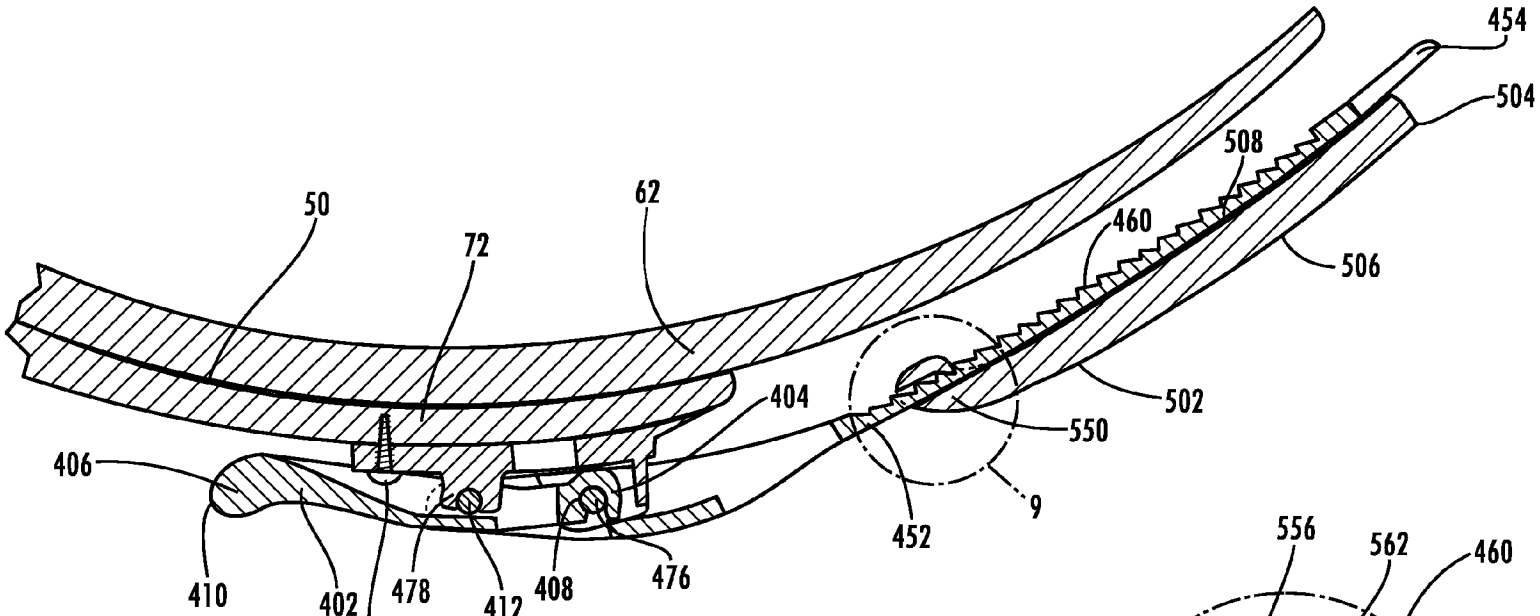
FIG. 8 is a longitudinal section of one part of the attachment system showing a buckle engaged with an anchor point, a buckle strap attached to the buckle, and the buckle strap engaged with the integrated buckle strap receiver.
Figure 9:
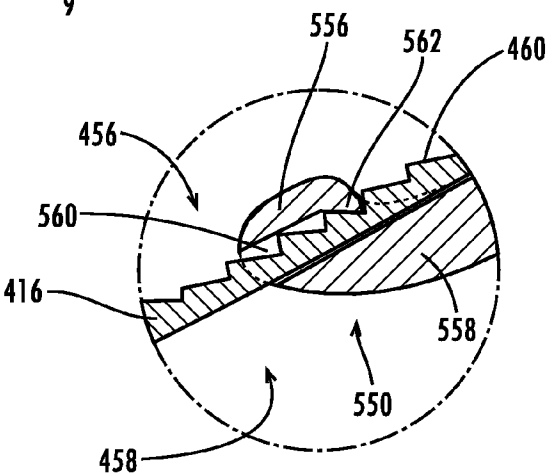
FIG. 9 is a close-up cross-section of the section indicated in FIG. 8 showing the integrated buckle strap receiver engaged with the buckle strap.
Figure 10:
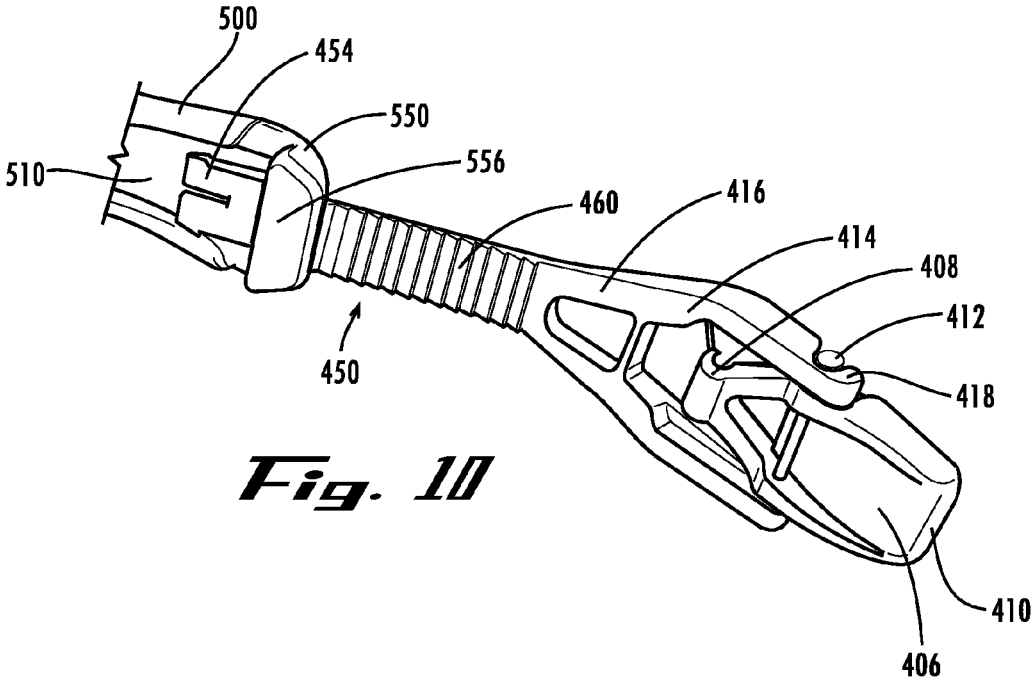
FIG. 10 is a close-up perspective view of the integrated buckle strap receiver engaging the buckle strap attached to a buckle.
Figure 11:
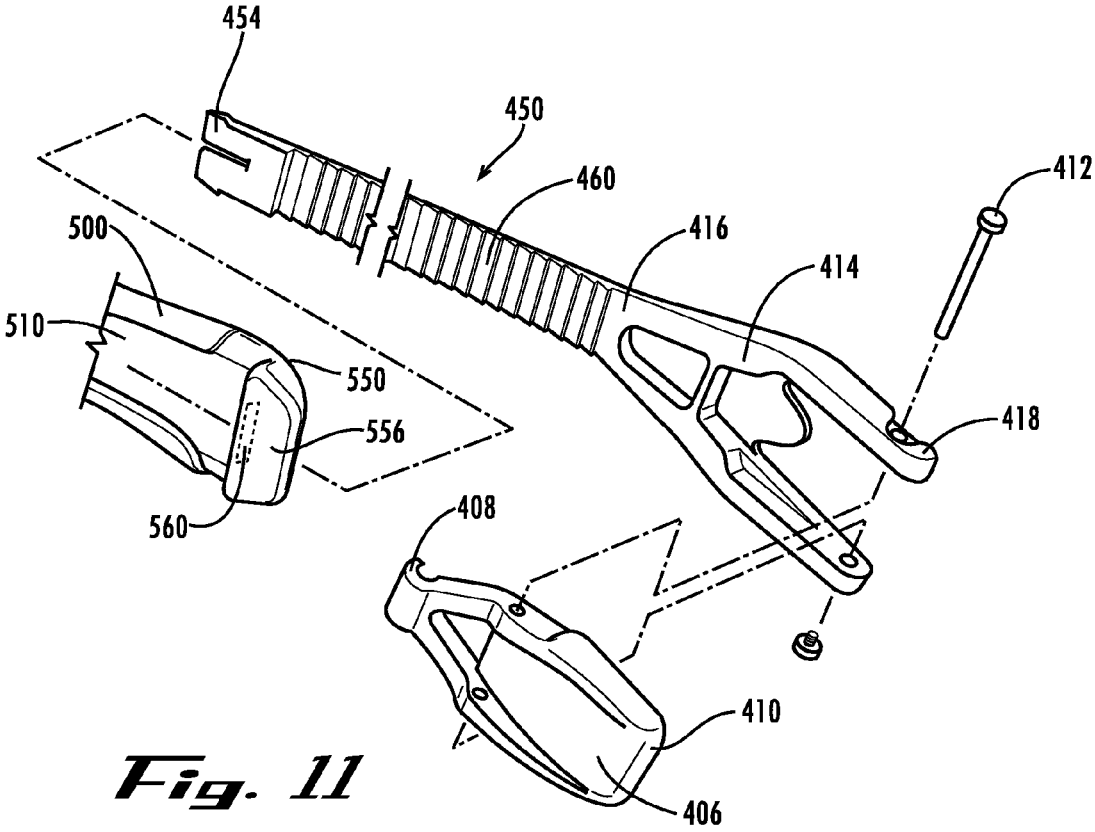
FIG. 11 is an exploded view of FIG. 10.

The exposed length of the buckle strap 450 between the integrated buckle strap receiver 550 and the buckle 450 may affect the fit of the attachment system. For example, the attachment system can provide a tighter fit if a greater length of the buckle strap 450 is pushed through the integrated buckle strap receiver 550, thus shortening the length of the buckle strap 450 at or adjacent to the first end 452 of the buckle strap 450 that lies exposed between the buckle 400 and the integrated buckle strap receiver 550. Tightening the attachment system can close the split 50 between the first flap 60 and second flap 70 of the upper, as shown in FIG. 8. Alternatively, the attachment system may be loosened by lifting or pulling the buckle strap 450 away from the head 556 integrated buckle strap receiver 550 to substantially or completely disengage the teeth 460 of the buckle strap 450 from the head 556 of the integrated buckle strap receiver 550 and then pulling more of the buckle strap 450 back out through the integrated buckle strap receiver 550.

The integrated buckle strap receiver may be formed from any suitable material including (but not limited to): natural and synthetic rubbers and elastomers such as polychloroprene, chlorosulfonated polyethylene, perfluoroelastomers, ethylene octene copolymers, EPDM (Ethylene Propylene Diene Monomer), and other polyolefins; or plastics and other polymers, such as LDPE (low density polyethylene), and polychloroprene latexes. In particular embodiments, the buckle strap may be produced from an injection molded thermoplastic, such as PE (polyethylene), HDPE (high density polyethylene), or high impact polypropylene.

The elongated overstrap 500 has a first end 502, a second end 504, a first side 506, and a second side 508. An optional recessed channel 510 may be defined by the second side 508 of the overstrap 500 for receiving a portion of the buckle strap 450 that has passed through the integrated buckle strap receiver 550. In particular embodiments, the recessed channel 510 may be sized to receive and frictionally retain that portion of the buckle strap 450 lying underneath the overstrap 500.

The integrated buckle strap receiver 550 is coupled to the first end 502 of the overstrap 500. Similar to the coupling between the buckle strap 400 and buckle 450, the overstrap 500 and integrated buckle strap receiver 550 may be tied, glued, or bonded together, or mechanically fixed to one another via bolts, rivets, snaps, stitching, staples and the like. In some preferred embodiments, however, the integrated buckle strap receiver 550 is co-molded with the overstrap during an injection molding process to form a unitary piece. An insert over-molding process is just one type of co-molding process useful for producing a unitary overstrap and integrated buckle strap receiver. For example, the head 556 and lug 558 portions can be injection molded separately and then over-molded together in a new mold along with the rest of the integrated buckle strap receiver (and perhaps the overstrap).

The second end 504 of the overstrap 500 is coupled to the first flap 60 of the upper 30. In some embodiments, the first flap 60 of the upper 30 may be a first portion 62 of the protective plastic shell 32. Similar to the coupling between the buckle strap 400 and buckle 450 and the coupling between the overstrap 500 and the integrated buckle strap receiver 550, the overstrap 500 may be tied, glued, or bonded to the first flap 60, or mechanically fixed to the second flap via bolts, rivets, snaps, stitching, staples or the like. In some preferred embodiments, however, the overstrap 500 is co-molded with the first flap 60 or first portion 62 of the hard plastic shell 32 during an injection molding process to form a unitary piece.

The overstrap may be formed from any suitable material including (but not limited to) the same materials used to make the buckle strap: natural or synthetic leather; natural or synthetic fabrics, such as cotton, hemp, polyester, nylon, rayon, spandex, or blended fabrics; fabrics containing carbon fiber or aramid (aromatic polyamide), meta-aramid, or para-aramid fibers, such as Nomex® or Kevlar® (DuPont Advanced Fibers Systems, Richmond, Va., USA); natural and synthetic rubbers and elastomers such as: polychloroprene, chlorosulfonated polyethylene, perfluoroelastomers, ethylene octene copolymers, EPDM (Ethylene Propylene Diene Monomer), and other polyolefins; or plastics and other polymers, such as LDPE (low density polyethylene), and polychloroprene latexes. In particular embodiments, the overstrap is produced from an injection molded thermoplastic, such as PE (polyethylene), HDPE (high density polyethylene), or high impact polypropylene.

The attachment system may be made using any suitable manufacturing process. In many embodiments, however, one or more parts of the attachment system are manufactured using an injection molding process employing a three-dimensional mold. Injection molding is a well-known manufacturing technique for making parts from a plastic or elastomeric material. Source material is heated and injected into a three-dimensional mold under high pressure. The mold may be precision-machined from metal (usually steel or aluminum) to form the desired dimensions and conformation of the manufactured part. In many cases, an injection-molded part requires no further modification or manipulation before being used to manufacture a device. However, in other cases, the injection-molded part may be polished, scored, painted, reheated, or otherwise worked, processed, or modified before it is used to manufacture a device. Specific injection molding processes and techniques are described in *Injection Molding Handbook,* Tim A. Osswald, Lih-Sheng Turng, and Paul J. Gramann, editors (Hanser Gardner Publications, October 2001, ISBN 1569903182) and John P. Beaumont, R. Nagel, and R. Sherman, *Successful Injection Molding: Process, Design, and Simulation,* 1st Edition (Hanser Gardner Publications, July 2002, ISBN 1569902917).

The attachment system described herein may be assembled through a variety of manufacturing processes. Generally speaking, such a method includes the following steps (which may be accomplished in almost any desired order):

1. providing a sole unit;
2. providing an upper having a split defining a first upper portion and a second upper portion, the second upper portion comprising a buckle anchor;
3. providing an overstrap having a first end and a second end, wherein the second end comprises an integrated buckle strap receiver having a unitary construction;
4. coupling the first end of the overstap to the first upper portion;
5. providing a buckle strap having a first end and a second end, wherein the first end of the buckle strap is capable of engaging the integrated buckle strap receiver;
6. providing a buckle capable of engaging and locking to the buckle anchor;
7. coupling the buckle to the second end of the buckle strap; and
8. attaching the upper to the sole unit.

The term "providing" is a non-limiting term meant to encompass any acquisition of a part, such as manufacturing the part or obtaining the part from third-party vendor or supplier.

Explanation of Terms

The following explanations of terms are intended to supplement, but not contradict or contravene, their ordinary dictionary definitions. While some terms are described relative to a human or animal body, the same descriptive terms can be adapted for use with inanimate objects, such as the protective footwear described herein. For example, the medial side of a motocross boot is the side closest to the midline of a wearer's body when the boot is worn.

Anterior. When referring to the human body, "anterior" structures or objects are near the front of the body. For example, the nose is located on the anterior side of the head. "Anterior" also corresponds to the term "ventral" used in general vertebrate biology.

Coronal plane. When referring to vertebrate anatomy, the coronal plane divides the body into dorsal and ventral portions (or, when referring to human anatomy specifically, the coronal plane divides the body into anterior and posterior portions).

Deep. When referring to human or animal anatomy, the term "deep" (also equivalent to "profound" or "internal") refers to structures that are inside the human body away from the body surface. For example, the hypothalamus is a deep gland within the human head.

Distal. When referring to a human or animal body, "distal" refers to a point that is further away from the main body (as opposed to "proximal"). For example, after a fly fisherman has made a cast, he has cast the distal end of the fishing line away from him.

Inferior. When referring to human anatomy, parts of the body that are "inferior" are farther away from the head. For example, the ankle is inferior to the knee.

Lateral. Those structures near the sides of a human or other animal, and further away from the body's midline, are described as being "lateral" (as opposed to "medial"). For example, the human ears are lateral to the human eyes, and the "pinky toe" of the foot is the most lateral toe.

Medial. Those structures near or closest to the midline of a human or other animal, and further away from the body's outsides, are described as being "medial" (as opposed to "lateral"). For example, the human breast bone is medial to either shoulder blade, and the "big toe" of the foot is the most lateral toe.

Median plane. In vertebrate anatomy, the median plane passes between the top and the bottom of the body and separates the left and the right sides of the body in equal halves.

Posterior. When referring to the human body, "posterior" structures or objects are near the back of the body. For example, the spine runs through the posterior portion of the torso. "Posterior" also corresponds to the term "dorsal" used in general vertebrate biology.

Proximal. When referring to a human or animal body, "proximal" refers to a point that is closer to the main body (as opposed to "distal"). For example, a person holding the very end of a rope holds the proximal end of that rope.

Sagittal plane. In vertebrate anatomy, a sagittal plane divides the body into left and right portions. The midsagittal plane falls within the midline of the body and passes through midline structures such as the human navel or spine. All sagittal planes are considered parallel to the midsagitall plane.

Superficial. When referring to human or animal anatomy, the term "superficial" (or "external") refers to structures that are on or close to the body surface. For example, sweat glands occupy a superficial position on the human body within the skin.

Superior. When referring to human anatomy, parts of the body that are "superior" are closer to the head. For example, the collar bone is superior to the pelvis.

Transverse plane. Regarding vertebrate biology, the transverse plane divides the body into cranial and caudal portions (or, when referring to human anatomy specifically, the transverse plane divides the body into superior and inferior portions). When referring to inanimate objects, a transverse plane runs perpendicular (or substantially perpendicular) to a longitudinal axis of the object.

Unitary piece. A "unitary piece" or "unitary part" is a single-unit construction made from one material or a mixture of materials fused or meshed together (such as an alloy, a blended plastic, or a fabric woven from a plurality of threads or yarns). An injection molded part (including a single piece made by a co-molding process) is considered a "unitary piece." A part constructed by joining two manufactured pieces together—such as by gluing or adhesively bonding, stapling, stitching, riveting, welding, or the like—is not considered a "unitary piece."

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein. All patent literature and non-patent literature cited herein is hereby incorporated by reference as if recited in full herein for all purposes.

What is claimed:

1. An item of footwear, comprising:

an upper comprising a first flap and an opposing second flap, wherein the second flap includes a buckle strap anchor;

an integrated buckle strap receiver comprising an overstrap and securing plate having a unitary construction, wherein a first end of the buckle strap receiver comprises an overstrap that is coupled to the first flap and the second end comprises the securing plate;

a buckle strap having a first end and a second end, wherein the first end of the buckle strap is capable of slideably engaging the integrated buckle strap receiver;

a buckle coupled to the second end of the buckle strap, wherein the buckle is capable of engaging the buckle strap anchor and tensioning the first flap relative to the second flap so that the portions are tightened around the foot or leg of a wearer;

wherein the first flap or second flap comprises a portion of an impact shield; and wherein the first end of the overstrap is co-molded with a portion of the impact shield.

2. An item of footwear, comprising:

an upper comprising a first flap and an opposing second flap, wherein the second flap includes a buckle strap anchor;

an integrated buckle strap receiver comprising an overstrap and securing plate having a unitary construction, wherein a first end of the buckle strap receiver comprises an overstrap that is coupled to the first flap and the second end comprises the securing plate;

a buckle strap having a first end and a second end, wherein the first end of the buckle strap is capable of slideably engaging the integrated buckle strap receiver;

a buckle coupled to the second end of the buckle strap, wherein the buckle is capable of engaging the buckle strap anchor and tensioning the first flap relative to the second flap so that the portions are tightened around the foot or leg of a wearer;

wherein the buckle strap comprises a set of teeth; and wherein the securing plate comprises a head and a lug separated by a gap and adapted to adjustably engage the teeth of the buckle strap.

3. The item of footwear according to claim 2, wherein a portion of the overstrap adjacent the first end comprises a recessed channel for snugly receiving the buckle strap.

4. The item of footwear of claim 3 wherein the anchor is adapted to pivotably receive an anchor receiving seat of the buckle.

5. A process of manufacturing protective footwear, comprising:

providing a sole unit;

providing an upper having a first portion and an opposing second upper portion, the second upper portion having a buckle anchor;

attaching the upper to the sole unit;

coupling an integrated buckle strap receiver to the first upper portion, the integrated buckle strap receiver comprising an overstrap and securing plate having a unitary construction, wherein a first end of the buckle strap receiver comprises an overstrap that is coupled to the first portion and the second end comprises the securing plate;

providing a buckle strap having a first end and a second end, wherein the first end of the buckle strap slideably engages the integrated buckle strap receiver and the second end comprises a buckle for engaging the buckle strap anchor and tensioning the first portion relative to the second portion so that the portions are tightened around the foot or leg of a wearer, and wherein attaching the upper to the sole unit transforms the sole unit in an article of protective footwear.

6. The process of claim 5, wherein the upper extends at least to a calf portion of a wearer, and wherein the upper defines an inner surface, an outer surface, and a top edge.

7. The process of manufacturing according to claim 6, wherein the protective footwear is intended for use in an off-road motorsport.

8. The process of claim 5 wherein the integrated buckle strap receiver is manufactured by an injection molding process.

9. The process of claim 8 wherein the injection molding process is a co-molding process.

* * * * *